United States Patent [19]

Hoffman

[11] Patent Number: 4,578,864

[45] Date of Patent: Apr. 1, 1986

[54] KNIFE HANDLE WITH THUMB WING

[76] Inventor: Phillip W. Hoffman, 29254 S. Lakeshore Dr., Agoura, Calif. 91301

[21] Appl. No.: 611,186

[22] Filed: May 17, 1984

[51] Int. Cl.[4] ..... B26B 3/06

[52] U.S. Cl. ..... 30/295; 30/161

[58] Field of Search ..... 30/295, 344, 155, 161

[56] References Cited

U.S. PATENT DOCUMENTS

| | | | |
|---|---|---|---|
| D. 57,935 | 5/1921 | Shively | 30/295 X |
| D. 202,780 | 11/1965 | Baer | 30/295 X |
| D. 248,039 | 5/1978 | Hoffman . | |
| 1,137,976 | 5/1915 | Hyde | 30/295 X |
| 1,754,543 | 4/1930 | Callum | 30/295 |
| 4,178,684 | 12/1979 | Mightly | 30/344 |
| 4,380,122 | 4/1983 | Jagger | 30/295 |

FOREIGN PATENT DOCUMENTS

| | | | |
|---|---|---|---|
| 729897 | 5/1932 | France | 30/295 |

OTHER PUBLICATIONS

Lakota Product Brochure, copyright 1981.

*Primary Examiner*—Jimmy C. Peters
*Attorney, Agent, or Firm*—Kolisch, Hartwell & Dickinson

[57] ABSTRACT

An improved knife having an elongate grip and a bolster joined to the grip adjacent the handles front end. The bolster includes a swept-forward thumb wing which extends adjacent a blade opposite the cutting edge to provide a wider-than-blade thumb-force-transmitting pressure platform.

5 Claims, 4 Drawing Figures

KNIFE HANDLE WITH THUMB WING

BACKGROUND AND SUMMARY OF THE INVENTION

The present invention pertains to an improved knife handle. Specifically, the invention relates to an elongate handle for a knife which includes a front bolster with a sweptforward thumb wing extending adjacent the rear portion of a knife blade. The thumb wing provides a thumb-force-transmitting pressure platform which enables a user, comfortably, to apply greater cutting pressure to a knife blade than would otherwise be possible without the provision of the thumb wing.

Provision of a thumb notch or thumb rest on the upper rear surface of a knife blade is known in the prior art. However, the thumb notch or thumb rest is a part of a steel blade, and is the same width as the blade adjacent its choil. While some additional force can be applied through such a notch, force application is usually neither very comfortable nor very effective because of the notch's relative lateral thinness. Additionally, if the knife is used during skinning or capping of game, fluids from the game will result in the blade and its associated thumb notch becoming slippery. The users hand may then slip off the blade, possibly contacting the sharpened surface of the blade.

An object of the instant invention is to provide a knife handle with a unique thumb-force-transmitting pressure platform which represents a significant improvement over prior art thumb notches.

More specifically, an object of the invention is to provide such a platform which enables, comfortably, the application of appreciable, "sure-footed" cutting force on a blade.

Another object of the invention is to provide a knife handle with such a platform which is an integral portion of the handle.

A further object of the invention is to provide a knife handle with a swept-forward thumb wing or platform which extends over the rear portion of a knife blade, with the top surface of the wing furnishing a platform of the type outlined.

The handle of the instant invention includes an elongate grip, which, in the case of a non-folding knife, substantially surrounds a rear tang end of a generally planar blade bar. The blade bar also has a forward, sharpened blade end extending beyond the handle. The handle includes a front bolster which is joined to the grip adjacent the handle's front end. The bolster is formed with a swept-forward thumb wing or platform which extends forwardly over the rear of the blade. The platform is substantially normal to the plane of the blade bar. The thumb wing provides a wide, thumb-force-transmitting pressure platform which allows a user, comfortably, to exert greater pressure on the blade than would otherwise be possible without the inclusion of the thumb wing. The thumb wing may be provided with a slip-inhibiting surface. In a preferred embodiment, the slip-inhibiting surface takes the form of transverse grooves extending across the wing.

Depending upon the particular design of a knife incorporating the present invention, the platform may be formed entirely within the structure of the bolster or blade bar. Alternatively, as is the case for the two embodiments of knives (folding and non-folding) illustrated and described herein, the central portion of the platform may in fact be formed by a part of the rear upper surface of the blade bar.

These and other objects and advantages of the instant invention will become more fully apparent when the description which follows is read in conjunction with the drawings.

DETAILED DESCRIPTION OF THE INVENTION

Figure 1:
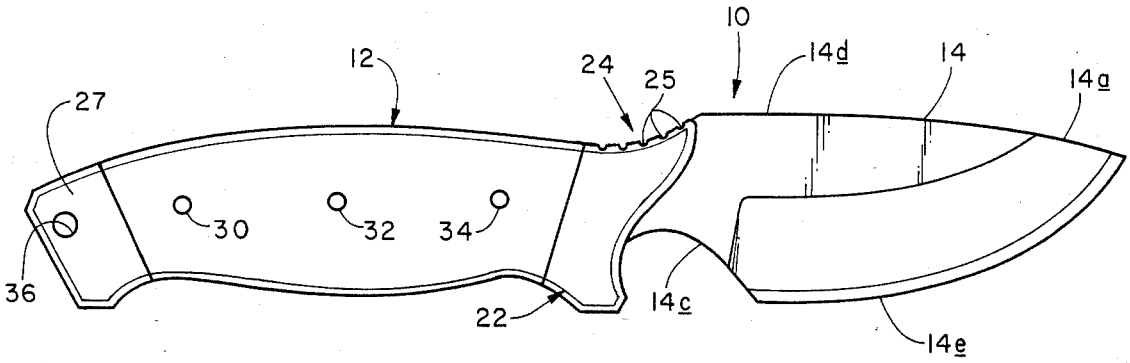
FIG. 1 is a side view of a fixed-blade knife incorporating a handle constructed in accordance with the present invention.
Figure 2:
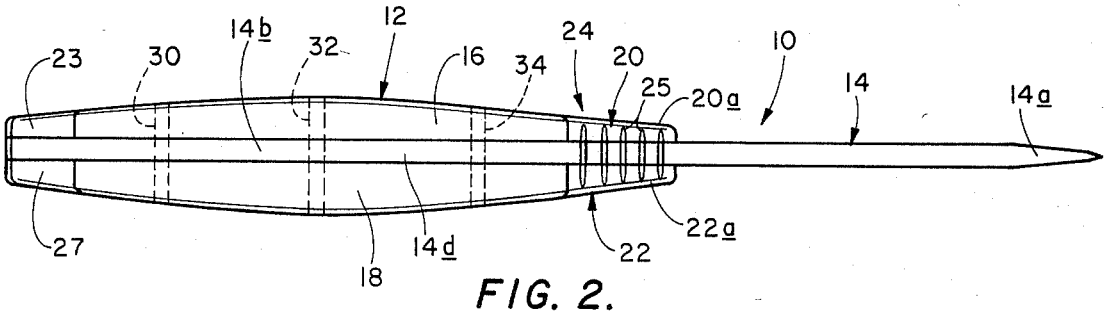
FIG. 2 is a view taken from the top of FIG. 1 illustrating the unique anti-slip pressure-transmitting platform.

Turning now to the drawings, and initially to FIGS. 1 and 2, a knife 10 which incorporates an elongate handle 12 with a thumb wing is depicted. A generally planar blade bar 14, which includes a forward blade end **14*a* and a rear tang end 14*b* is fixedly connected to handle 12. Blade end 14*a* extends from the forward end of the handle. The blade bar includes a pair of longitudinal edges. One edge 14*c* forms the bottom surface of the blade bar. Another edge 14*d* is opposite edge 14*c* and forms the top surface of the blade bar. Edge 14*c* includes a sharpened cutting portion 14*e* adjacent the distal end of bar 14. As can be seen in FIG. 2, except for portion 14*e*, bar 14** has a generally uniform transverse thickness.

Referring to FIG. 2, handle 12 includes an elongate grip with a left grip portion 16 and a right grip portion 18. Forming a front bolster means in the front end of the handle, and therefore the front end of the grip, are left and right bolster parts 20, 22, respectively. These bolster parts in the forward end of the handle are adapted to receive the tang end of blade bar 14. Tang end **14*b* extends rearwardly along the entire length of handle 12**.

The upper portions of parts 20, 22 include laterally displaced, swept-forward extension portions **20*a*, 22*a***, which collectively define what is referred to herein as an extension or thumb wing.

Portions **20*a*, 22*a*, together with the adjacent stretch of blade bar edge 14*d*, form a thumb-force-transmitting pressure platform, or platform means, 24 opposite edge 14*c*. Platform 24 has a surface generally normal to the plane of the bar whose transverse width is greater than the transverse thickness of bar 14 adjacent the platform. Further, the portion of bar 14** below the extension portion is exposed.

The platform has a slip-inhibiting surface which takes the form of a series of transverse grooves, shown at 25.

Completing the description of knife 10, the elongate grip terminate at its rear end in bolster parts 23, 27. Bolster parts 20, 22, 23, 27 are suitably permanently affixed to tang end **14*b*. Grip portions 16, 18 are secured to the tang end by pins 30, 32, 34. In a typical embodiment, blade bar 14 and the bolster parts are formed from stainless steel. Grip portions 16, 18** are formed from hardwood or high-strength plastic material. The pins fastening the grip portions may be stainless steel or brass.

A lanyard bore 36 is formed in the butt end of the handle to accommodate attachment of a lanyard to the knife.

Figure 3:
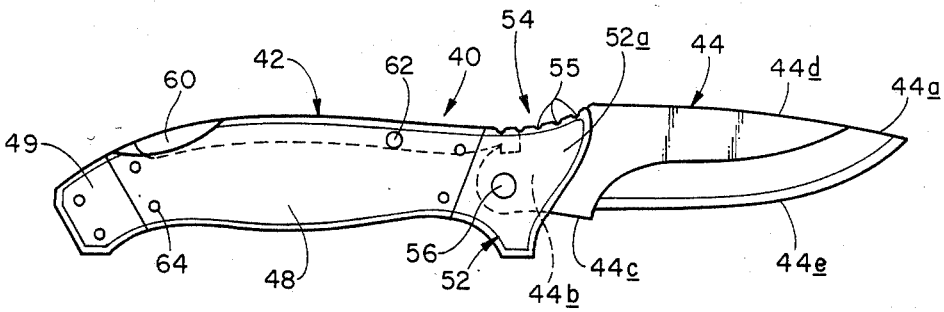
FIG. 3 is a view similar to FIG. 1 showing a folding-blade knife incorporating a handle made in accordance with the invention.
Figure 4:
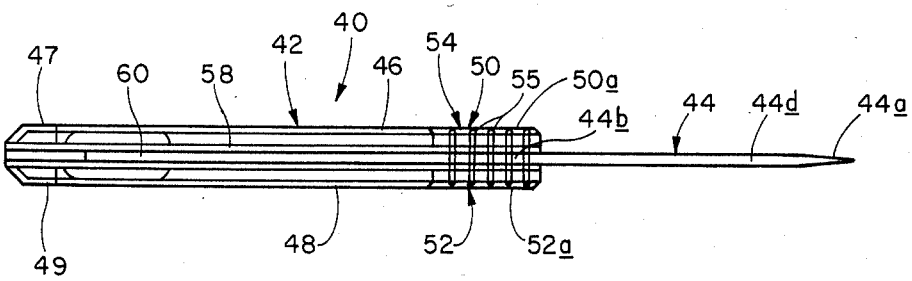
FIG. 4 is a view similar to FIG. 2 taken from the top of FIG. 3.

Turning now to FIGS. 3 and 4, a folding knife 40 is depicted. Knife 40 incorporates the features thus described in conjunction with knife 10. Like knife 10, knife 40 has an elongate handle 42 and a blade bar 44. Blade bar 44 includes a forward blade end 44*a* which extends from the forward end of handle 42, and a rear tang end 44*b*, which is received by the forward end of handle 42. Blade bar 44 includes a pair of longitudinal edges 44*c* and 44*d* which correspond to edges 14*c* and 14*d*, respectively, in bar 14. A cutting portion 44*e* is formed in edge 44*c* adjacent blade end 44*a*.

Handle 42 includes a left grip portion 46 and a right grip portion 48. A pair of bolster parts 47, 49 are located at the rear end of the handle. Also, a left bolster part 50 and a right bolster part 52 are joined to the grip adjacent the handle's forward end, and like bolsters 20, 22, include swept-forward extension portions 50*a*, 52*a*, respectively. The extension portions and the adjacent stretch of edge 44*d* provide a thumb-force-transmitting pressure platform 54 opposite edge 44*c*. Platform 54, like platform 24, has a surface whose transverse width is greater than the transverse thickness of bar 44 adjacent the platform. Transverse grooves 55 extend across the platform, thereby forming a slip-inhibiting surface on platform 54.

Knife 40 further includes a blade rotation pin 56 which allows blade bar 44 to rotate between an open, locked position as shown, and a folded position (not shown). Blade end 44*a* folds into a sleeve 58 which, in this embodiment, is located inside handle 42. Sleeve 58, in a typical embodiment, is formed of brass and has spaced apart sides and an opening into which the blade folds. Formation of a sleeve in a folding knife is well known in the prior art. Additionally, a lock bar 60 and lock bar pin 62 cooperate to fix blade bar 44 in place, in an open position. Use of such a lock bar and lock bar pin is also well known in the prior art.

Grips 46, 48 and bolster parts 47, 49 are fixed to sleeve 58 by pins, such as pin 64. Bolster parts 50, 52 are secured to the sides of sleeve 58 by rotation pin 56.

When the knives previously described herein are in use, the user grasps the handle around the grip and rests his thumb on the platform defined by the front bolster parts and the associated blade edge. Although the platform has been described with a slip-inhibiting surface, it should be recognized that provision of such a platform on a knife which is intended for use in the home would not necessarily require the inclusion of the slip-inhibiting platform. The platform does enable a user to comfortably apply greater cutting pressure to the knife blade than would otherwise be possible without the provision of the platform. Further, having the portion of the bar below the platform exposed allows for a more direct pressure from the platform to the working or cutting portion of the blade.

Although preferred embodiments of the improved knife handle have been described, it is appreciated that variations and modifications may be made without departing from the spirit of the invention.

It is claimed and desired to secure as Letters Patent:

1. In a knife having, in operative condition, an elongate generally planar blade bar having opposite blade and tang ends and having a pair of oppositely disposed, longitudinally extending edges with one of said edges having a cutting portion disposed adjacent the blade end, an improved elongate handle comprising an elongate grip having a forward end, and bolster means disposed on said forward grip end and attached to the tang end with the blade end extending from said bolster means away from said grip, said bolster means including an upswept, forward projecting extension extending along the other edge of the bar along both sides of the blade end and having a platform disposed generally normal to the plane of the bar, said platform having a transverse width greater than the transverse thickness of the bar adjacent the platform, a portion of the bar immediately opposite from said platform being exposed, said platform being coincident with said other edge and terminating along the upper portion of said edge.

2. The handle of claim 1, wherein said platform has a thumb-slip-inhibiting surface.

3. The handle of claim 2, wherein said surface includes grooves extending generally normal to the plane of the bar.

4. A knife in operative condition, comprising an elongate, generally planar blade bar having oppositely disposed blade and tang ends and having a pair of oppositely disposed, longitudinally extending edges with one of said edges having a cutting portion disposed adjacent one end of said bar and the other of said edges having a forwardly upswept portion beginning at the juncture of the blade and tang ends and extending along said blade end, and an elongate handle having a forward end joined to said tang end with said blade end extending from the forward end of said handle, the region of said bar adjacent said handle's forward end having a generally uniform predetermined thickness, said handle further including an elongate grip having a forward end associated with the forward end of said handle and bolster means disposed on the forward end of said grip, said bolster means including an upswept, forward projecting extension portion extending along each side of said upswept portion of the other edge of said bar and being conformal therewith, said extensions forming, in combination with a portion of said other edge, a platform disposed generally normal to the plane of said bar and having a transverse width greater than the previously mentioned predetermined bar thickness, said platform having a slip-inhibiting surface extending generally normal to the plane of the bar.

5. The knife of claim 4 wherein said slip-inhibiting surface includes plural grooves extending generally normal to the plane of the bar.

* * * * *